US006786113B2

(12) United States Patent
Brailsford et al.

(10) Patent No.: US 6,786,113 B2
(45) Date of Patent: Sep. 7, 2004

(54) RING OPENER

(76) Inventors: Stephen Nicholas Brailsford, 34 Beaconsfield Avenue Coach House, Toronto, Ontario (CA), M6J 3H9; Ivan Romero Mendez, 585 Balliol Street, Toronto, Ontario (CA), M4S 1E1

( * ) Notice: Subject to any disclaimer, the term of this patent is extended or adjusted under 35 U.S.C. 154(b) by 0 days.

(21) Appl. No.: 10/726,792

(22) Filed: Dec. 3, 2003

(65) Prior Publication Data

US 2004/0103759 A1 Jun. 3, 2004

Related U.S. Application Data

(63) Continuation-in-part of application No. 10/307,598, filed on Dec. 2, 2002.

(51) Int. Cl.[7] ..... B67B 7/16

(52) U.S. Cl. ..... 81/3.55; 81/3.07; 81/3.08; 81/3.09; 81/3.4; 81/3.56

(58) Field of Search ..... 81/3.55, 3.08, 81/3.07, 3.09, 3.56, 3.4; 224/217, 218

(56) References Cited

U.S. PATENT DOCUMENTS

| | | | | | |
|---|---|---|---|---|---|
| 1,519,816 | A | | 12/1924 | Ward | |
| 1,558,418 | A | | 10/1925 | Wendel | |
| 1,578,627 | A | | 3/1926 | Baumgarten | |
| 2,146,272 | A | | 2/1939 | Skoog | |
| 2,548,517 | A | * | 4/1951 | Clark | 81/3.57 |
| 4,120,216 | A | | 10/1978 | Goldberg | |
| 4,466,313 | A | | 8/1984 | Gardner | |
| 4,667,544 | A | | 5/1987 | Milo | |
| 4,765,208 | A | * | 8/1988 | Sakosky | 81/3.55 |
| 4,825,728 | A | | 5/1989 | Mitchell | |
| D303,915 | S | | 10/1989 | Knutson | |
| 5,022,288 | A | * | 6/1991 | Taktakian | 81/3.4 |
| 5,029,495 | A | * | 7/1991 | Rosenberger | 81/3.09 |
| 5,133,233 | A | | 7/1992 | Erwin | |
| D337,708 | S | | 7/1993 | Morris, Jr. | |
| D347,152 | S | | 5/1994 | Mohawk et al. | |
| 5,329,832 | A | * | 7/1994 | Tegethoff | 81/3.55 |
| 5,347,890 | A | | 9/1994 | Rufkahr | |
| D373,941 | S | * | 9/1996 | Davis | D8/40 |
| 6,098,497 | A | | 8/2000 | Larose | |
| D438,075 | S | | 2/2001 | Van Meter | |
| D454,765 | S | | 3/2002 | Jansson | |

* cited by examiner

*Primary Examiner*—Joseph J. Hail, III
*Assistant Examiner*—Alvin J Grant
(74) *Attorney, Agent, or Firm*—Young & Basile, P.C.

(57) ABSTRACT

A ring opener for opening tab-top cans and capped containers having a lip portion for removing a container tab when engaged with the container tab, and a tooth portion for removing a container cap from the container's mouth when applied to the container cap.

16 Claims, 4 Drawing Sheets

RING OPENER

RELATED APPLICATIONS

This is a continuation-in-part of co-pending application Ser. No. 10/307,598 which was filed on Dec. 2, 2002.

FIELD OF THE INVENTION

The present invention relates to container openers, and more particularly to a ring for opening tab-top cans and capped containers.

BACKGROUND OF THE INVENTION

Bartenders and waiters often require to open a large number of beverage containers in a fast and expeditious manner. Most beverage containers are in the form of a bottle having a removable top cap, or cans including a frangible top portion and a tab hingedly attached to the top of the can above the frangible-portion, such that upon lifting the tab, the tab levers the frangible portion downwardly, thereby allowing access to the contents of the can.

A number of opening devices currently exist to assist bartenders and waiters in opening beverage containers. However, known openers have a number of problems. A primary difficulty associated with existing openers is that they can be easily lost or misplaced, for a professional bartender must intermittently place down the opener, mix or serve a drink, charge the customer, and look for the opener again in order to serve another customer.

Furthermore, known hand-held openers typically have a long handle, which may be burdensome to manipulate and carry around, as the operator must remove other items such as money held in his or her hand in order to manipulate the opener.

Various hand wearable container opening devices have been proposed in the past to address the foregoing problems. However, the proposed wearable openers are generally cumbersome to use, are not ergonomically designed, and have sharp edges which may break fingernails or cause cuts to the hand of the operator.

BRIEF SUMMARY OF THE INVENTION

The present invention provides a ring opener for opening tab-top and capped containers which addresses the shortcomings associated with known openers.

The present invention arises from the realization that existing openers are cumbersome to use and generally cannot be used to open both tab-top and capped containers in an expeditious manner. Accordingly, the present invention provides a ring opener wearable on a hand's finger, wherein the ring is configured and shaped to assist the operator in removing a bottle cap or lift-opening a container tab. Advantageously, a removable bezel including an insignia or a trademark could be attached to the ring to be used as corporate advertisement or prize. The ring can be worn on any finger by either right handed or left handed users and can be adjusted to accommodate fingers of differing thicknesses. Conveniently, the ring includes a rubber comfort linking to absorb some of the pressure exerted by a container cap or tab against the operator's finger to prevent injuries. A number of ventilation holes may also be included on the ring to prevent liquid or sweat built-up between the ring and the operator's finger.

The present invention provides a ring for opening a capped bottle wherein the ring comprises a body portion favorably sized for accommodating an operator's finger therein wherein the body portion defines a cap receiving area having opposed edges for engaging a container's cap, and a comfort insert for substantially absorbing the pressure exerted on the operator's finger by the body portion.

The present invention also provides a ring for opening a tab-top container or a capped bottle wherein the ring comprises a body portion favorably sized for accommodating an operator's finger therein. The body portion further defines a cap receiving area having opposed edges for engaging a container's cap, as well as a lip extending outwardly from the body portion for engaging a container's tab wherein the lip terminates in a hook member.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Reference will now be made to the accompanying drawings, which show, by way of example, embodiments of the present invention, and in which.

DETAILED DESCRIPTION OF THE EMBODIMENT

Figure 1:
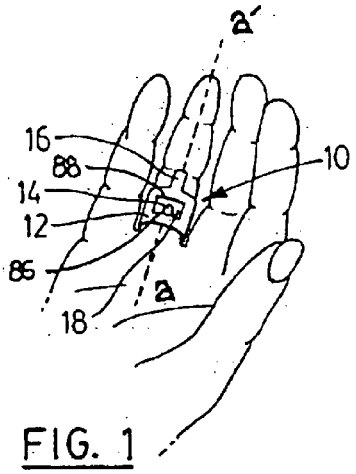
FIG. 1 is a perspective view of the ring opener worn on an operator's hand according to an embodiment of the present invention.

The present invention is now described with reference to accompanying drawings, wherein like constituent elements are designated by like reference numerals throughout the drawings.

FIG. 1 illustrates a ring opener worn on an operator's finger in accordance with an embodiment of the current invention. The ring opener 10 includes a generally ring-shaped body 12 to frictionally engage an operator's finger. The ring opener body 12 includes a lip 16 for grasping a container tab, and a generally arcuate tooth 14 for engaging a container cap. The ring opener body 12 can be made of different sizes to accommodate fingers of various sizes and can be conveniently worn on any finger of the right or left hand.

Figure 5:
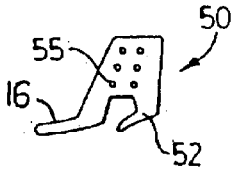
FIG. 5 is a side elevational view of another embodiment of the present invention having ventilation holes.

The lip 16 projects circumferentially from the upper edge of ring opener body 12 and is substantially parallel to the centerline a–a' of the operator's finger. Advantageously, the lip 16 terminates in a tapered portion as illustrated in FIG. 5 to ease the insertion of the lip 16 between a container tab and the container top.

The cap-engaging tooth 14 protrudes into a recess area 18, also referred to herein as a "cap receiving area", in the ring body 12 which is adapted to accommodate a container cap therein. The tooth 14 extends substantially parallel to the centerline a–a' of the operator's finger and may extend in an offset plane with respect to the plane of the lip 16. As can be appreciated from FIG. 1, the tooth 14 extends from a lower edge 86 of the recess area 18, and terminates at an end that is spaced apart from an upper edge 88 of the recess area 18.

For ease of fabrication, the lip 16 and the tooth 14 are an integral part of the ring opener body 12. Advantageously, the ring body 12 is made of hard plastic or non-corrosive metals such as aluminum or stainless steel in order to prevent the ring body 12 from rusting, which may cause irritation to the operator's skin. Advantageously, the ring body 12 may be magnetized in order to attract opened tabs or caps or coins.

Figure 2:
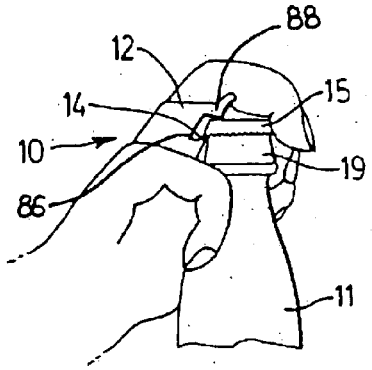
FIG. 2 is a perspective view of the ring opener in position during de-capping of a capped container according to the present invention.
Figure 3:
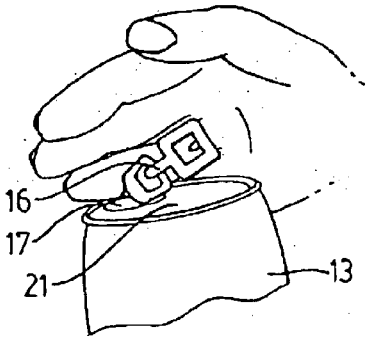
FIG. 3 is a perspective view of the ring opener in position during removal of a tab-top container's tab according to the present invention.

Reference is now made to FIGS. 2 and 3 wherein the ring opener 10 is shown in operation. The ring opener 20 is first inserted over the operator's finger, such that the lip 16 and tooth 14 face the palm of the operator. Referring to FIG. 2, when opening a capped-top container 11 having a mouth 19 sealed by a cap 15, the tooth 14 is first inserted between the cap 15 and the container mouth 19, such that the recess area 18 houses the cap and the upper edge 88 of the recess 18 engages the top of the cap 15 therein while at the same time the tooth 14 engages or "bites" the lower edge of the cap 15. The operator can then de-cap the container 11 by flexing his or her hand upwardly while at the same time exerting pressure on the cap 15, causing the ring opener 10 to first pivot about its upper edge 88 to loosen a portion of the edge of the cap 15, and then collectively pivot the opener 10 and the cap 15 against the container mouth 19 to pry off or remove the cap 15 from the mouth 19. Referring now to FIG. 3, when opening a container 13 having a tab 17, the lip 16 is gently slid under the tab 17 to position it between the tab 17 and the container top 21. Upward movement of the operator's hand causes the lower end of tab 17 to lever downwardly and pierce the frangible portion of the container top 21, thereby providing access to the container's 13 content.

Figure 4:
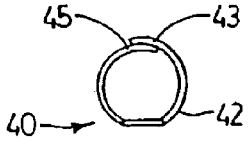
FIG. 4 is a top plan view of a size-adjustable embodiment of the present invention.

Reference is now made to FIG. 4 which illustrates another embodiment of the present invention which is similar to ring opener 10 except that the ring opener 40 includes a body 42 having overlapped end portions 43, 45, and the ring is made of a rigid but pliable material to allow variation in the effective ring opener body 42 size by varying the overlap of the end portions 43, 45 in order to accommodate fingers of varying sizes or shapes.

There is shown in FIG. 5 a further embodiment of the present invention. The ring opener 50 varies from ring opener 10 in that it includes a body 52 defining a plurality of ventilation holes 55 to prevent built-up of liquid or sweat between the ring and the operator's finger.

Figure 6:
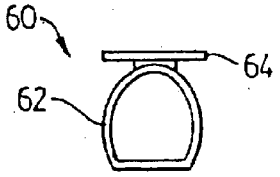
FIG. 6 is a top plan view of an embodiment of the present invention having a bezel.
Figure 7:
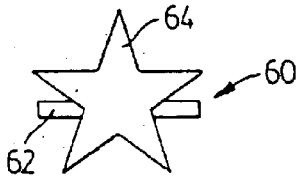
FIG. 7 is a front plan view thereof.

Referring to FIGS. 6 and 7, there is shown a ring opener 60 according to yet another embodiment of the present invention. The ring opener 60 is similar to ring opener 10, with the addition of a custom bezel 64 attached to the ring opener body 62. The bezel 64 could be removable, or permanently affixed to the ring opener body 62 by soldering, adhesive, press-tab, or like methods as known in the art. Alternatively, the bezel 64 may form an integral part of the ring opener body 62. The bezel 62 preferably includes an insignia or a trademark to promote a product, or a decorative design in order to give the ring opener a jewelry-like appearance. Furthermore, the bezel 64 may be iridescent for enhanced visual effects.

Figure 8:
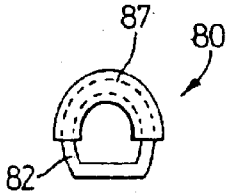
FIG. 8 is a top plan view of an embodiment of the present invention having comfort linking.

FIG. 8 illustrates an embodiment of the present invention, a ring opener 80 having a ring body 82 similar to that of the ring opener 10, however, the ring body 82 is covered by a layer of comfort linking 87 generally substantially along its length. The comfort linking 87 may be located over the part of the ring opener 80 that passes over the outside of the operator's finger. The comfort linking may be pliable, made of plastic, rubber, leather, or other similar material to absorb some of the pressure exerted on the operator's finger while opening a capped or tab-top container.

Figure 9:
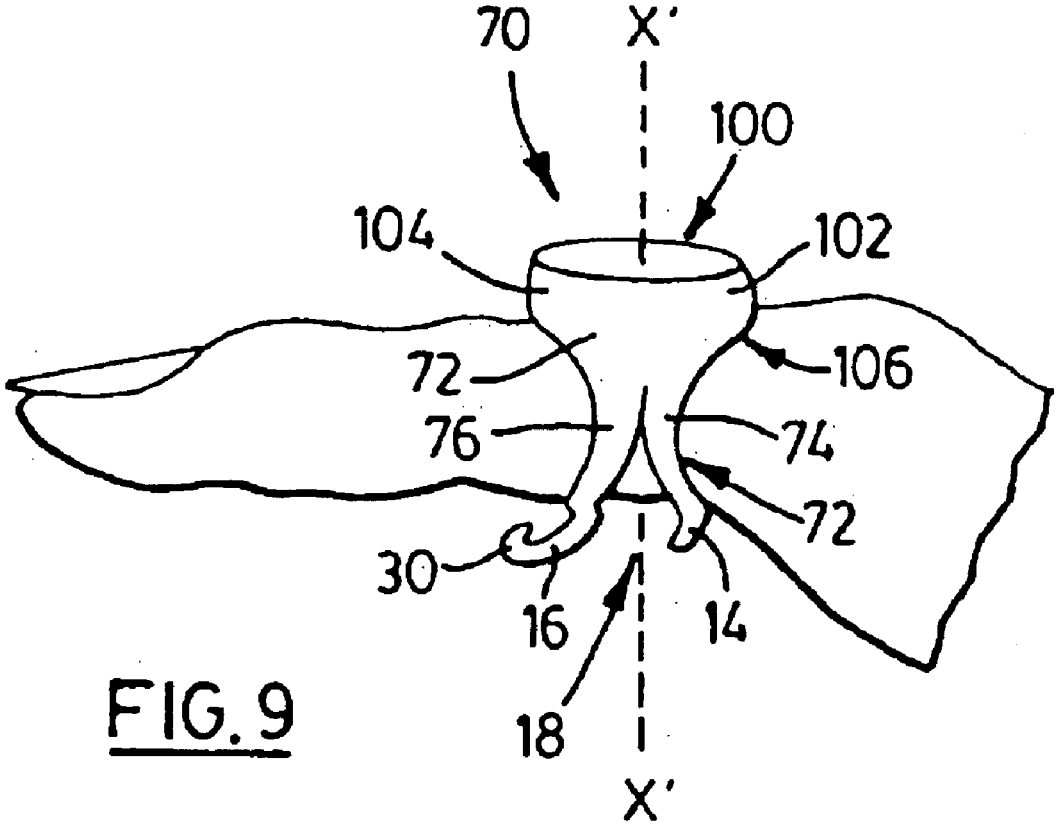
FIG. 9 is a side view of an embodiment of the present invention having a hook member as worn on an operator's hand.
Figure 10:
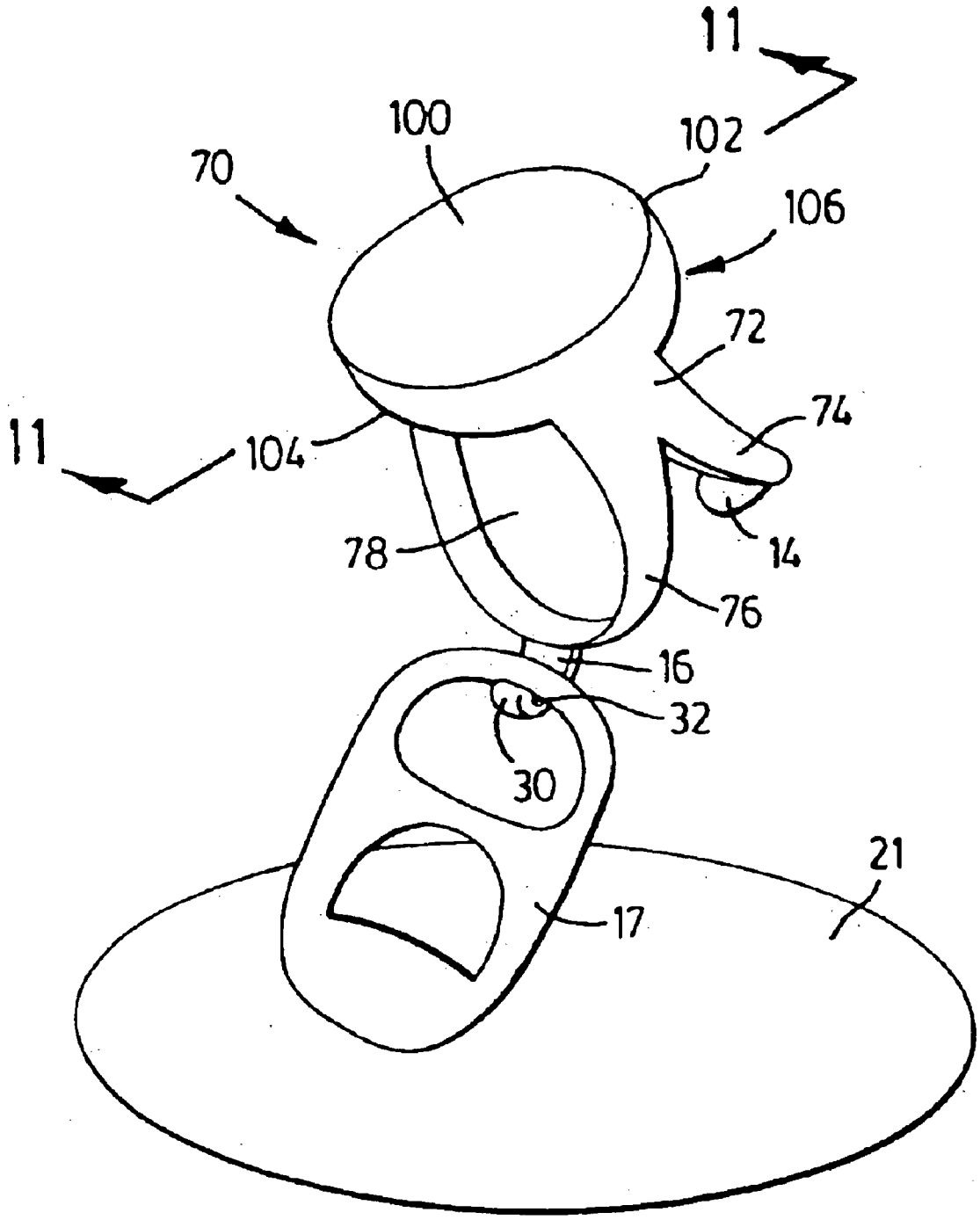
FIG. 10 is a perspective view of an embodiment of the present invention having a hook member.

Reference is now made to FIG. 9 which shows a ring opener, indicated generally by reference 70, according to another example embodiment of the invention. Ring opener 70 is similar to ring opener 10 except for differences which will be apparent from the Figures and the present description. The body portion 12 includes a crown 100 joined to an arcuate band member 72. Preferably, the crown 100 and the band member 72 are integrally joined.

The ring opener 70 has a central plane x'—x'. Band member 72 is comprised of diverging band members 74 and 76. The crown is composed of a first part 102 and a second part 104. By way of orientation, the first part of the crown 102 and diverging band member 74 are located to one side of the central plane x'—x' and the second part of the crown 104 and diverging band member 76 are located to the other side of the central plane x'—x'.

The diverging band members 74 and 76 extend outwardly from each other in a curved path with the ends of each of the diverging band members 74 and 76 converging at opposite sides of the crown 100. Together, the diverging band members 74 and 76 define the cap receiving area 18 as described above in relation to FIG. 1, with the tooth 14 extending from diverging band member 74 and with the lip 16 extending from diverging band member 76.

When the ring opener 70 is worn, the band member 72 will wrap around the underside and sides of the operator's finger and the crown 100 will be oriented on the topside of the operator's finger.

A bezel can be attached to the crown 100 or alternatively, a design or lettering can be engraved directly into the exterior surface of the crown 100.

Ring opener 70 includes a hook member 30 adapted for engaging a container 21 having a tab 17. Preferably, the hook member 30 is an integral extension of the lip 16 wherein the terminus of the lip 16 is curled or bent upwards towards the underside of the operator's finger to form the hook member 30. The hook member 30 defines a tab receiving area 32 which is adapted to accommodate a container tab 17. The hook member 30 allows the lip 16 to securely engage the container tab 17 and prevents the lip 16 from slipping off of the container tab 17. By allowing more steadfast engagement of the lip 16 with the container tab 17, leverage is improved thereby facilitating the ease in which the operator can open the container 21. In use, as shown in FIG. 9, the lip 16 is first slid through the opening 36 of the container tab 17 and then pulled back and upwards such that the hook member 30 catches the top portion 34 of the container tab 17. With the container tab 17 securely held by the hook member 34, the operator can then open the container 21 as described above in relation with FIG. 3.

As compared to ring opener 10, ring opener 70 is lighter in weight, and thus more comfortable to wear, as less material is required to construct the diverging band members 74 and 76 of ring opener 70 as compared to the solid ring body 12 of ring opener 10. The use of diverging band members 74 and 76 also increases operator comfort by distributing the pressure exerted by the ring opener 70 over a larger area of the operator's finger. Use of diverging band members 74 and 76 further increases operator comfort by allowing improved air flow between the ring opener 70 and the operator's finger.

Ring opener 70 includes a comfort insert 106 to provide a protective cushion between the operator's finger and the ring opener 70. During the opening of a capped bottle or a tabbed container, the operator experiences localized areas of pressure as the result of the ring opener 70 pressing on certain parts of the operator's finger. The repetitive engagement of the ring opener 70 with the operator's finger can result in discomfort and user fatigue. The majority of discomfort experienced by the operator is caused by the pressing of the first part of the crown 102 into the topside of the operator's finger.

Figure 11A:
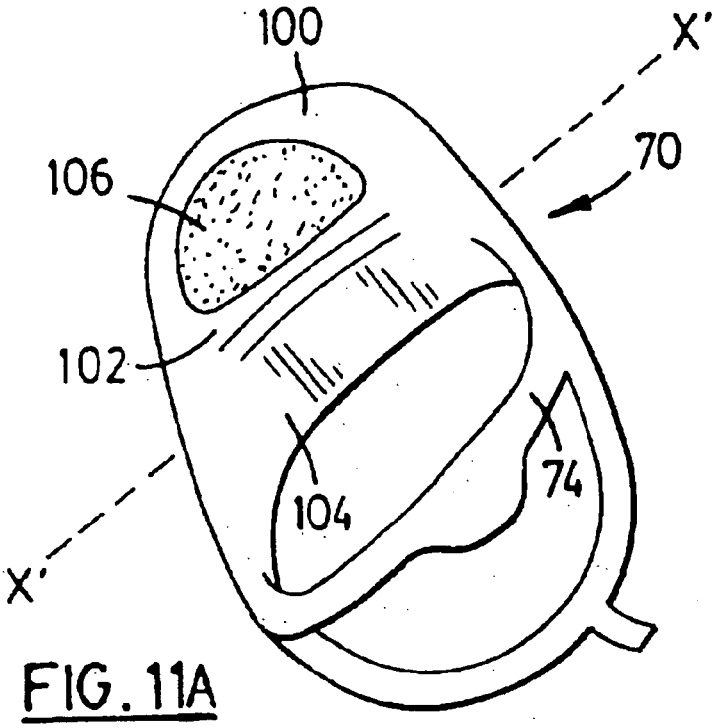
FIG. 11A is a perspective view of an embodiment of the present invention having a comfort insert.
Figure 11B:
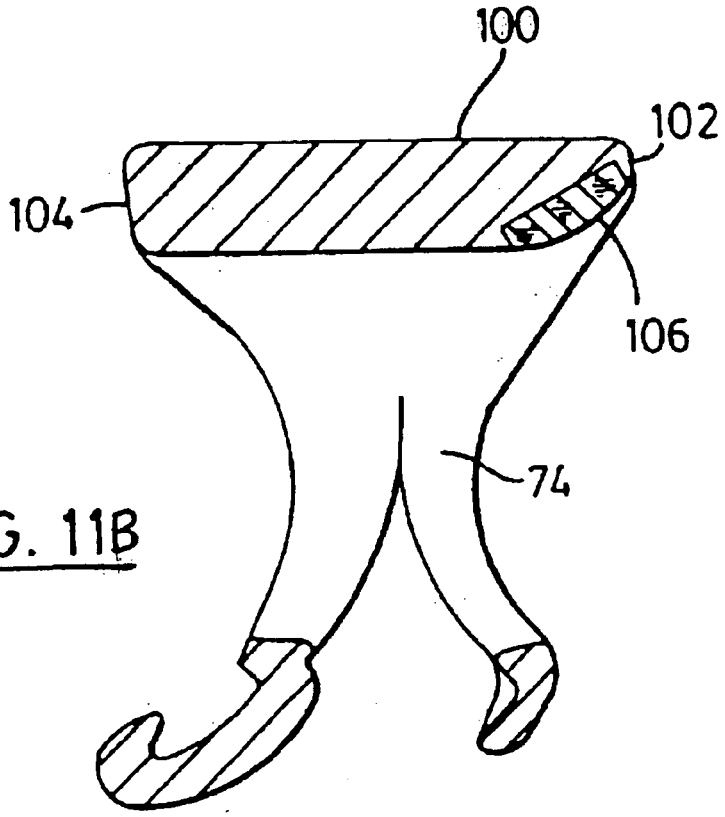
FIG. 11B is a cross sectional view of an embodiment of the present invention having a comfort insert.

Reference is now made to FIG. 11A which illustrates the underside of the first part of the crown 102 of ring opener 70. The comfort insert 106 can be located on any portion of the ring opener 70 which exerts pressure on the operator's finger. The comfort insert can be located on an interior surface of the ring such that the comfort insert 106 is hidden or partially hidden from view when the ring opener 70 is worn. Preferably, the comfort insert 106 is located on the underside of the first part of the crown 102 as shown in FIG. 11B. The comfort insert 106 can be mounted within the first part of the crown 102 such that the interior surface of the crown 100 and the comfort insert 106 are adapted to match the contours of the operator's finger. Usually, the comfort insert 106 is a resiliently deformable material and preferably, the comfort insert 106 is a waterproof rubber which provides suitable cushioning against the pressure exerted by the ring opener 70 and which is adapted for use in the wet environment of a bar. Other materials with similar cushioning properties can also be used, including plastic or leather. The comfort insert 106 can be attached to the ring opener 70 with a suitable adhesive. Alternatively, the comfort insert 106 can be inset into a portion of the ring opener 70 and held in place by way of mechanical force.

The present invention may be embodied in other specific forms without departing from the spirit or essential characteristics thereof. Certain adaptations and modifications of the invention will be obvious to those skilled in the art. For instance, the size of the ring opener may be adjusted by other ring size adjustment techniques known in the art. Moreover, the portions that form the lip 16 and tooth, 14 could have shapes other than those shown in the figures. In some embodiments, the tooth 14 could be absent, with the lower edge 86 of the recess area 18 being used to engage the lower edge of a cap 15 to lever it off the bottle 11. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A ring for opening a capped bottle, the ring comprising:

a body portion favorably sized for accommodating an operator's finger therein, the body portion defining:

a cap receiving area on a first side of the body portion having opposed edges for engaging a container's cap; and a comfort insert to substantially absorb the pressure exerted by the body portion on the operator's finger wherein the comfort insert is located on an interior surface of the body portion.

2. The ring according to claim 1, wherein body portion comprises a band member and a crown and the comfort insert is located on an interior surface of the crown.

3. The ring according to claim 2, wherein one of the opposed edges of the receiving area defines a tooth extending into the receiving area for engaging a container's cap and wherein the comfort insert is located on an interior surface of the crown adjacent to said one edge defining the tooth.

4. The ring according to claim 1, wherein the comfort insert is made of cushioning material selected from a group comprising: rubber, plastic, or leather.

5. The ring according to claim 1, further adapted for opening a tab-top container, wherein the body portion further defines a lip extending outwardly from an end of the body portion on the first side for engaging a container's tab.

6. The ring according to claim 2, wherein the band member comprises a first and second band member wherein the first and second band members converge at opposite sides of the crown.

7. The ring opener according to claim 6 wherein the lip extends from an edge of the first band member and the tooth extends from an edge of the second band member.

8. The ring according to claim 1, wherein the ring body portion is made of non-corrosive material selected from the group consisting of aluminum, stainless steel, and plastic.

9. The ring according to claim 1, wherein the ring body portion is magnetized.

10. The ring according to claim 2, further comprising an outward facing bezel attached to the crown.

11. A ring for opening a tab-top container and a capped bottle, the ring comprising:

a body portion favorably sized for accommodating an operator's finger therein, defining:

a cap receiving area on a first side of the body portion having opposed edges for engaging a container's cap wherein one of the opposed edges of the receiving area defines a tooth extending into the receiving area for engaging a containers cap; and a lip extending outwardly from an end of the body portion on the first side for engaging a container's tab wherein the lip terminates in a hook member.

12. The ring according to claim 11, wherein the body portion comprises a band member and a crown and said band member comprises a first and second band member wherein the first and second band members converge at opposite sides of the crown.

13. The ring opener according to claim 12, wherein the lip extends from an edge of the first band member and the tooth extends from an edge of the second band member.

14. The ring according to claim 11, wherein the ring body portion is made of non-corrosive material selected from the group consisting of aluminum, stainless steel, and plastic.

15. The ring according to claim 11, wherein the ring body portion is magnetized.

16. The ring according to claim 12, further comprising an outward facing bezel attached to the crown.

* * * * *